US005283967A

United States Patent [19]

Abrams

[11] Patent Number: 5,283,967

[45] Date of Patent: Feb. 8, 1994

[54] MULTI-PURPOSE DISPLAY FRAME

[76] Inventor: Charles Abrams, 10 Buckminster Rd., Rockville Centre, N.Y. 11570

[21] Appl. No.: 897,922

[22] Filed: Jun. 15, 1992

[51] Int. Cl.[5] ..... G09F 1/12

[52] U.S. Cl. ..... 40/155; 40/152; 40/156

[58] Field of Search ..... 40/152, 152.1, 154, 40/156, 158.1, 653, 5, 642

[56] References Cited

U.S. PATENT DOCUMENTS

| | | | |
|---|---|---|---|
| 132,314 | 10/1872 | Moulton | 40/152 |
| 153,283 | 7/1874 | Shatto | 40/152 |
| 1,757,485 | 5/1930 | Singer | 40/5 |
| 1,882,157 | 10/1932 | Minton | 40/152.1 |
| 2,083,403 | 6/1937 | Rowe | 40/653 |
| 2,649,799 | 8/1953 | Spertus | 40/152 |
| 3,286,382 | 11/1966 | Newman | 40/156 |
| 3,589,049 | 6/1971 | Cornelius | 40/152 |
| 4,274,567 | 6/1981 | Sawyer | 40/642 X |
| 4,777,746 | 10/1988 | Brooks | 40/152.1 |
| 4,794,714 | 1/1989 | Weisgerber | 40/158.1 X |

*Primary Examiner*—Kenneth J. Dorner

*Assistant Examiner*—J. Bonifanti

*Attorney, Agent, or Firm*—Galgano & Burke

[57] ABSTRACT

A multi-purpose, front-loading display frame includes a front frame member having a window section for viewing a display item disposed therebehind and a rear frame member for releasably supporting at least one interchangeable display item. The front frame member is hingedly secured to the rear frame member so as to allow for pivotable movement of the frame members between a closed position, in which the frame members are disposed closely adjacent to one another so that a display item supported on the rear frame member is disposed behind the window section for viewing, and an open position, in which the frame members are pivoted apart from one another to permit removal and replacement of the display item. A closure member is mounted on at least one of the front and rear frame members for releasably maintaining the front and rear frame members in the closed position thereof. The closure member is positioned to allow the front frame member to be swung open while the rear frame member is still mounted on a support.

11 Claims, 3 Drawing Sheets

MULTI-PURPOSE DISPLAY FRAME

BACKGROUND OF THE INVENTION

1. Field of the Invention

The present invention relates to a multi-purpose display frame. More particularly, it relates to a swing-open, front loading wall display frame for displaying printed memorabilia, such as magazines, comic books, paintings, photographs, documents, diplomas and other graphic art items and collectibles.

2. The Prior Art

Various picture, poster and other multi-purpose frames are available for displaying a wide variety of printed graphic art material. (See, for example U.S. Pat. No. 4,822,195, to Lu; U.S. Pat. No. 5,018,291, to Pasquale et al; and U.S. Pat. No. 4,984,798, to Silberstein.) In particular, U.S. Pat. No. 4,446,206, to Meadows, discloses a picture frame which includes a substantially flat transparent window surrounded by a frame member which, in turn, is hingeably secured to a substantially flat closure back panel holding the intended graphic against the transparent window when the closure back panel is in a closed position. A combination latch and hanger member is provided for hanging the frame and maintaining the front and back panels in a closed position, and the device preferably includes a plurality of compression pads which press against the graphic when the closure back panel is in the closed position. However, to change the picture, one most remove the frame from the wall to enable one to open the latch, swing open the back flap, and remove and replace the old picture. This procedure occurs every time the art work needs to be inserted, removed or replaced. In addition, the top portion of the latch protrudes above the frame which is aesthetically unacceptable.

U.S. Pat. No. 4,958,458, to Hillstrom et al, discloses a poster display frame fastened via conventional means to a rigid supporting member such as posts, walls or the like. The sides of the Hillstrom frame comprise sets of both front and back frame members which are interconnected and pivotably engaged and made from extruded metal or molded plastic. A spring member is necessary to bias the front and back frame members into mating pivotal engagement and bias the front frame members against the poster and backing frame member when the frame sections are closed, as well to hold the front frame members in their open positions. This frame requires complicated fabrication/molding of the frame members and hinge assembly. The Hillstrom frame requires a rather complicated cylindrical hinge o pivot pintle formation on the back of the back frame member and a corresponding cup-shaped socket portion formed on the back panel of the front frame member. The two are joined either slidably or snapped together. The Hillstrom device also cannot use conventional industry standard metal picture frame extrusions.

U.S. Pat. No. 4,947,565, to Shadwell, discloses a picture framing assembly which includes a rectangular picture frame that can be opened and closed repeatedly for mounting and changing the picture to be displayed in the frame. The picture framing device is characterized by a rigid backing sheet which is hinge mounted along one edge of the frame and releasably secured to the frame along the other three edges with adhesive tape. The device has a backing sheet having an adhesive strip on the surface of the mat facing the backing sheet for releasably securing the picture to be displayed to the mat. Here, too, like Meadows, the picture frame must be removed from the wall to allow for the opening and closing of the backing sheet. In addition, the backing sheet is hinged by tape which is also taped around the other edges of the frame. Slight finger pressure must be used in an opening in the corner of the backing sheet to release the backing sheet and provide access to the recessed cross-section of the frame to enable one to insert, remove, or replace the picture to be displayed. The picture frame is re-sealed by re-securing the tape all around the back of the frame. This does not permit ready access and is time consuming.

U.S. Pat. No. 4,756,108, to Lackay et al, discloses a display frame for displaying posters, advertisements and other printed matter which has a rectangular front frame which supports a transparent window which, in turn, is hingeably mounted at its bottom to a vertical solid face via vertical support modules. The vertical solid face includes a compressible backing for holding display material in place behind the window which must be removed when replacing the picture. The device also requires a rather complicated hinge and clamping device.

In summary, each of the above frames have substantial disadvantages. Some are rather complicated in construction, and others are difficult to use to effect replacement of the display item. Furthermore, others do not afford sufficient protection and ease of use for framing collectibles in a non-damaging manner, which is important for maintaining the value of the printed graphic such as comic books cartoon cells, baseball cards and the like.

SUMMARY OF THE INVENTION

Accordingly, it is an object of the present invention to provide a novel, multi-purpose display frame which is relatively simple in design, easy to use and economical to fabricate.

It is a more particular object of the present invention to provide such a novel display frame which can be used to frame a multitude of items in a safe, yet accessible, manner by providing a swing-open, front-loading, wall display frame.

Certain of the foregoing and related objects are readily attained according to the present invention by the provision of a multi-purpose display frame which includes a front frame member having a window section for viewing a display item disposed therebehind and a rear frame member having a front surface for releasably supporting at least one interchangeable display item. The frame also includes hinge means for hingeably securing the front frame member to the rear frame member so as to allow for pivotable movement of the frame members between a closed position, in which the frame members are disposed closely adjacent to one another so that a display item supported on the rear frame member is disposed behind the window section for viewing, and an open position, in which the frame members are pivoted apart from one another to permit removal and replacement of the display item. Closure means is also provided and is mounted on at least one of the front and rear frame members for releasably maintaining the front and rear frame members in the closed position thereof. The closure means is positioned so as to allow the front frame to swing outwardly via pivotable movement into the open position, while the rear frame member is secured on a support.

In a preferred embodiment of the invention, one of the frame members has a recessed cavity in which the other of the frame members is receivable when the frame members are in the closed position. Most desirably, the front frame member is provided with this cavity. The front frame member preferably comprises a rectangular frame having top, bottom, and two side frame sections joined together to form a frame about an open area for display and a transparent window panel mounted within the frame sections and occupying the open area s as to provide a front supporting and protective surface to the display item in the display frame. Advantageously, the front frame member includes a rectangular mat board mounted in the frame member behind the window panel.

The rear frame member preferably comprises a rectangular frame having top, bottom and two side frame sections joined together to form a frame about an open area for display support and a display rear support for the display item mounted within the frame sections and occupying the display support open area so as to provide a rear support for the display item.

The rear support advantageously comprises a rear panel which fits within the rear frame sections and has a flat surface for holding the display item against the window panel of the front frame member when the frame members are in the closed position. In a particularly preferred embodiment, at least a portion of the flat surface of the rear panel is provided with adhesive means capable of temporarily adhering the display item to the rear panel. Most advantageously, the rear panel is compressible in the rear frame member so as to accommodate display items of different thickness. Preferably, the rear panel is spring loaded.

The hinge means advantageously comprises a piano-type hinge. The closure means may comprise latch means desirably comprising a functionally releasable spring latch.

The front frame member sections preferably have a channeled rear surface, and the piano-type hinge has a front U-shaped leaf securably received in the rear surface channel and a rear L-shaped leaf secured to a frame section of the rear frame member.

Most advantageously, the display frame additionally includes hanger means in the form of an L-shaped bracket, one leg of which is securable to a wall and the other leg of which is securable to the rear frame member, for mounting the frame on a wall.

BRIEF DESCRIPTION OF THE DRAWINGS

Other objects and features of the present invention will become apparent from the following detailed description considered in connection with the accompanying drawings which disclose one embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF THE PREFERRED EMBODIMENT

Figure 1:
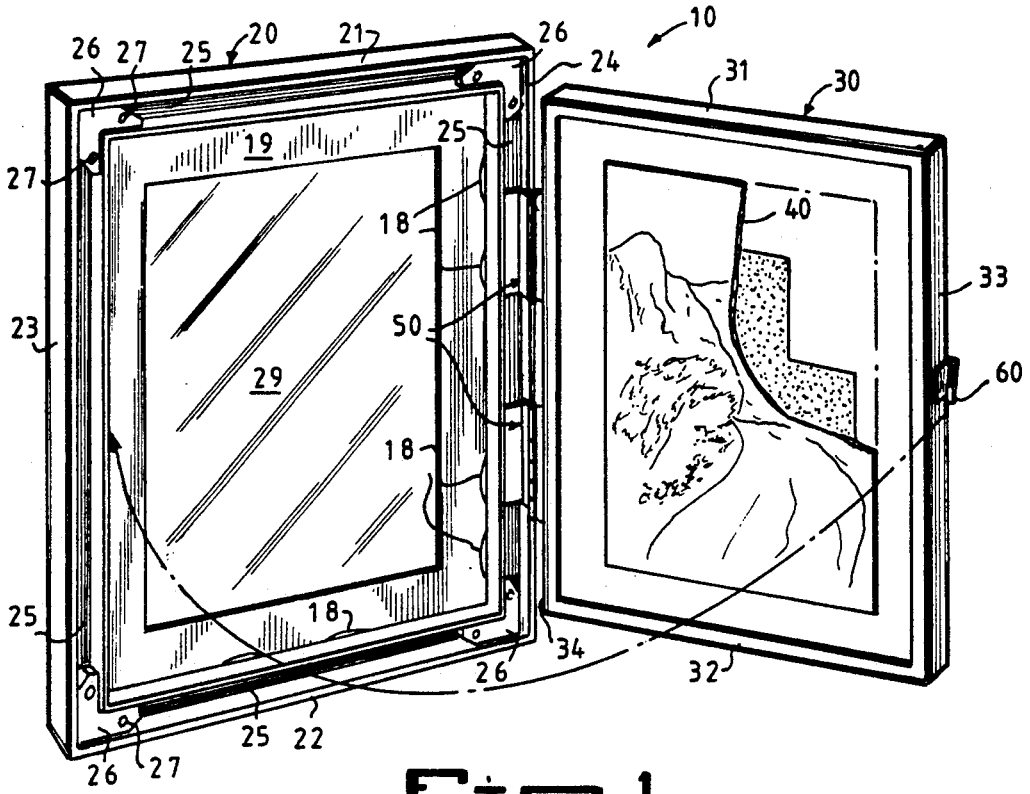
FIG. 1 is a perspective view of a display frame embodying the present invention in an open position, with the rear frame section supporting a graphic display item, partially broken away to show the rear panel of the picture frame.
Figure 2:
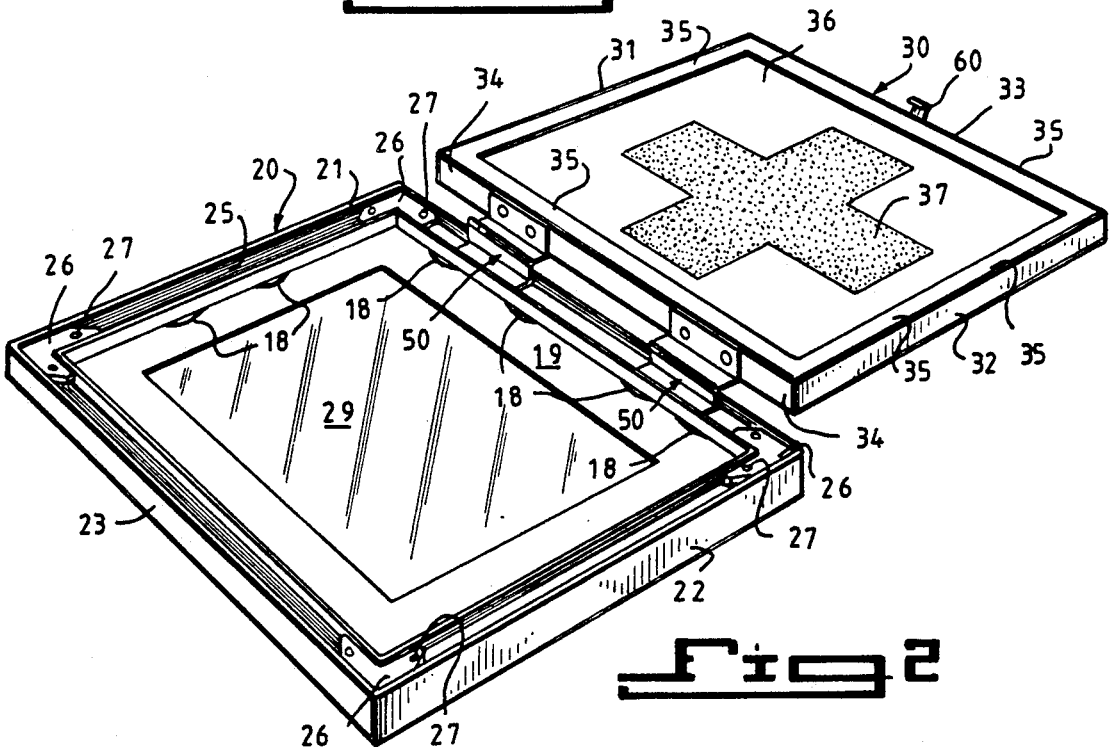
FIG. 2 is a perspective view showing the picture frame in a fully open position.

Turning now in detail to the drawings, and in particular to FIGS. 1 and 2 thereof, therein illustrated is a novel, multi-purpose, front-loading display frame embodying the present invention, generally designated by reference numeral 10, which is composed of a front frame member, generally designated 20, and a rear frame member, generally designated 30.

Front frame member 20 comprises a conventional, single channel metal frame which includes a top frame section 21, a bottom frame section 22, and two side frame sections 23, 24, which cooperatively define a rearwardly-opening, generally C-shaped or U-shaped channel 25. Frame sections 21, 22, 23, 24 are joined together by corner angle plates or brackets 26 which are received in channel 25, where said frame sections meet, and which are secured therein by screws, bolts or the like 27.

Figure 5:
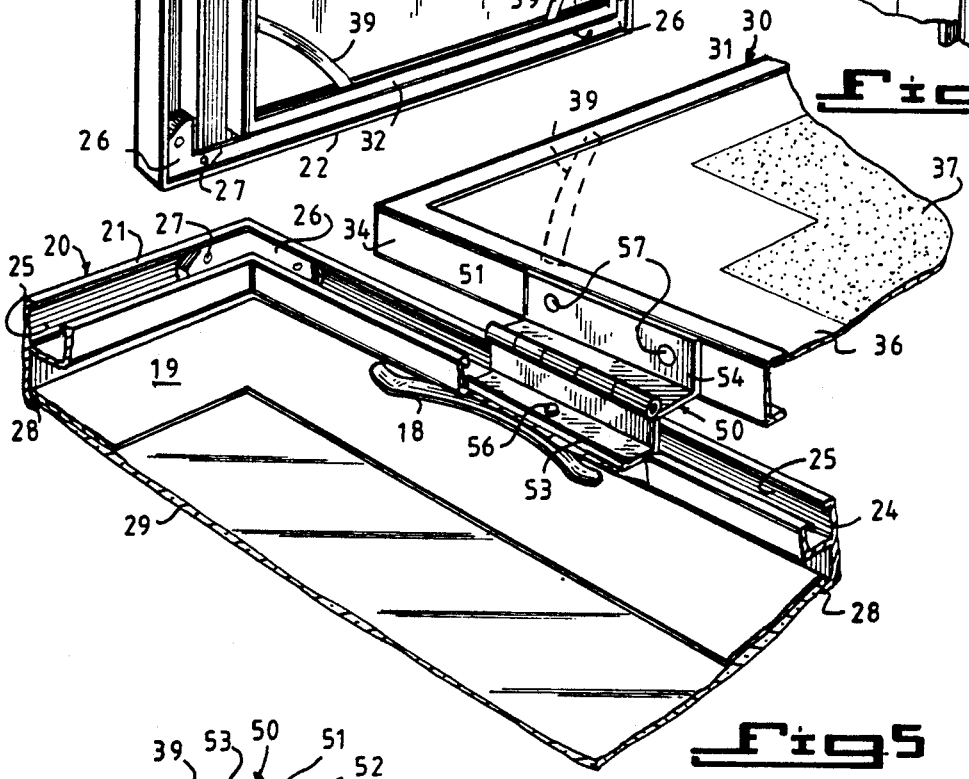
FIG. 5 is an enlarged, fragmentarily illustrated perspective view of a portion of the frame assembly shown in FIG. 2.
Figure 6:
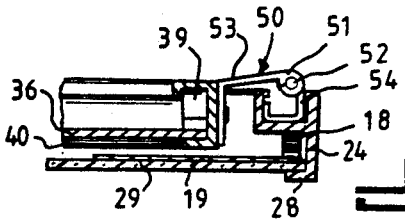
FIG. 6 is an enlarged, fragmentarily illustrated sectional view taken along lines 6—6 of FIG. 3.

As been seen in FIGS. 5 and 6, frame sections 21, 22, 23 and 24 are each provided with a front lip or flange 28, behind which is sandwiched a substantially flat and transparent glass or plastic pane or window 29 and a rectangular cardboard mat 19, which are held in place via leaf springs 18, which are provided on each frame section 21, 22, 23 and 24 (only several of which are viewable).

The rear rectangular frame 30 comprises a conventional metal, back loading frame which also includes four frame sections—namely, a top frame section 31, a bottom frame section 32, and two side frame sections 33, 34 which are joined to each other at their respective ends and each of which are also provided with a top lip or flange 35. As seen best in FIGS. 3 and 4, behind lip 35 lies a substantially flat, cardboard support panel 36 which is supported in a spring-loaded fashion by leaf springs 37. Support panel 36 has a top surface which is provided with an adhesive section 37 in the form of a cross, to which a display item may be adhesively retained in a releasable, temporary manner. The adhesive would have a holding strength, such as that provided by The 3M Company for its Post-It TM paper which has a low tack and allows the art work 40 to remain fixed to panel 36, while also allowing the art work 40 to be removed and replaced numerous times without the adhesive section 37 loosing its adhesive property, or more importantly, damaging the art work 40. Alternatively, a double-sided adhesive tape from the same company could be used on the surface of panel 36. The top frame section is also provided with three mounting holes 38 formed therethrough, the purpose of which will be described in greater detail hereinafter.

As best seen in FIGS. 5 and 6, front frame section 20 is joined to the rear frame section 30 by means of a pair of piano-type hinges, generally designated 50. Each piano-type hinge 50 is a continuous steel hinge having a barrel 51 in which is received a hinge pin 52 and two leaves—namely, a front L-shaped leaf 53 and a rear U- or C-shaped leaf 54. Each leaf 53, 54 is tooled to bend and conform to its corresponding frame. More particularly, front leaf 52 is shaped and formed to slide into the C-shaped rear channel of the front frame via screws, e.g., hexset screws, 56, rivets 57, or the like.

Figure 3:
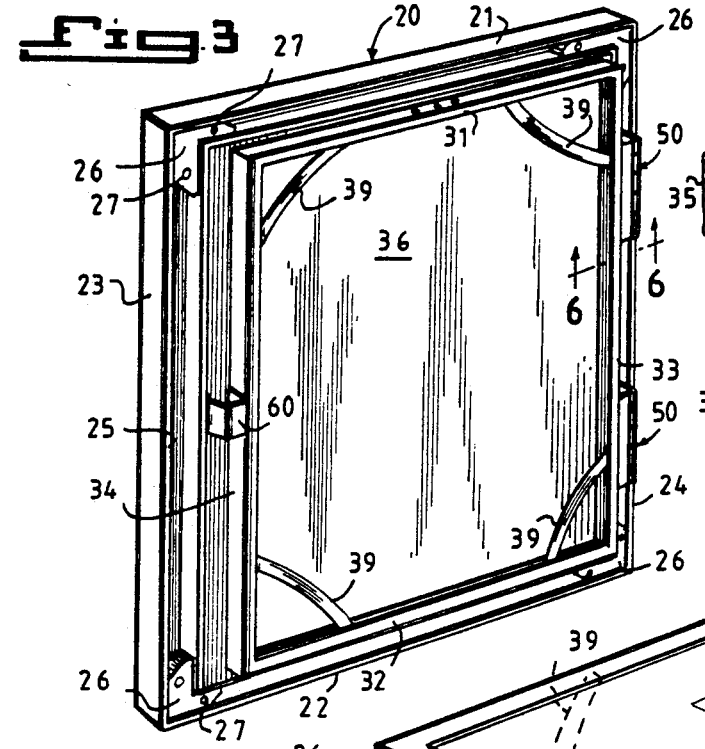
FIG. 3 is a rear perspective view of the picture frame in a closed position.
Figure 4:
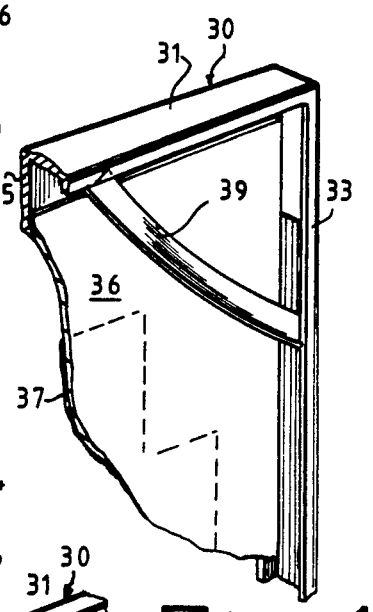
FIG. 4 is an enlarged, fragmentarily illustrated, rear perspective view of a portion of the rear panel shown in FIG. 3.

As can be seen by a comparison of FIGS. 1 and 2 relative to FIGS. 3 and 6, the frames 20, 30 are movable via hinge 55 between an open position (FIGS. 1 and 2) and a closed position (FIGS. 3 and 6), in the latter position of which back frame 30 fits into the larger front frame 20 with an approximately and preferably one-half inch space between both frames. A generally U-shaped steel spring latch 60 is attached to frame section 33 of back frame 30, which grabs the inner side of frame section 23 in a friction-fit manner to maintain the same in a normally closed position. However, the friction fit allows for easy opening of the front frame 20 when desired.

When the frame is hung on the wall, the smaller, rear frame 30 will be flush against the wall, and the outer, larger frame 20 will extend approximately 5/16 of an inch from the wall. This allows the outer front frame to swing open and stop at a 90° angle from the wall. This "front loading" makes it easy to remove and exchange the graphic display item 40, while the frame 10 is still mounted on the wall. The wall also acts as a brace to hold the outer frame to a 90° angle, and not beyond. Otherwise, the smaller frame could be pried from the wall. The new frame has a custom, quality, designed look, similar to a standard frame.

With the hinge hidden substantially within the C-shaped channel 25 of the single frame 20, there is no immediate indication that the frame 10 opens from the front. As can be appreciated, this frame can be used in the home or business environment and may be used for displaying printed memorabilia and numerous other forms of printed graphic art items. The frame itself is designed to look like a conventional, familiar, attractive, quality metal picture frame. Although it appears to be a simple frame, it is, in fact, two frames, one inside the other, the smaller, rear frame being hidden from view by the glass and mat board inserted in the larger, outer front picture frame. The specially designed concealed hinge allows the frame to swing open from the front, facilitating easy access so that the art work can be exchanged and placed quickly and easily while the frame is still hanging on the wall. The latch is also hidden from view and all mounting hardware and holes, etc., are on the rear frame so they, too, will normally be concealed and hidden from view.

Figure 7:
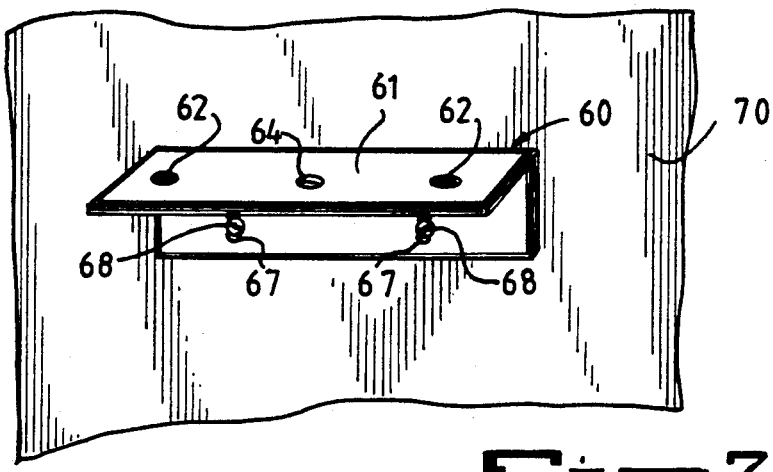
FIG. 7 is an enlarged, perspective view of a wall hanger bracket for hanging the frame mounted on a wall.
Figure 8:
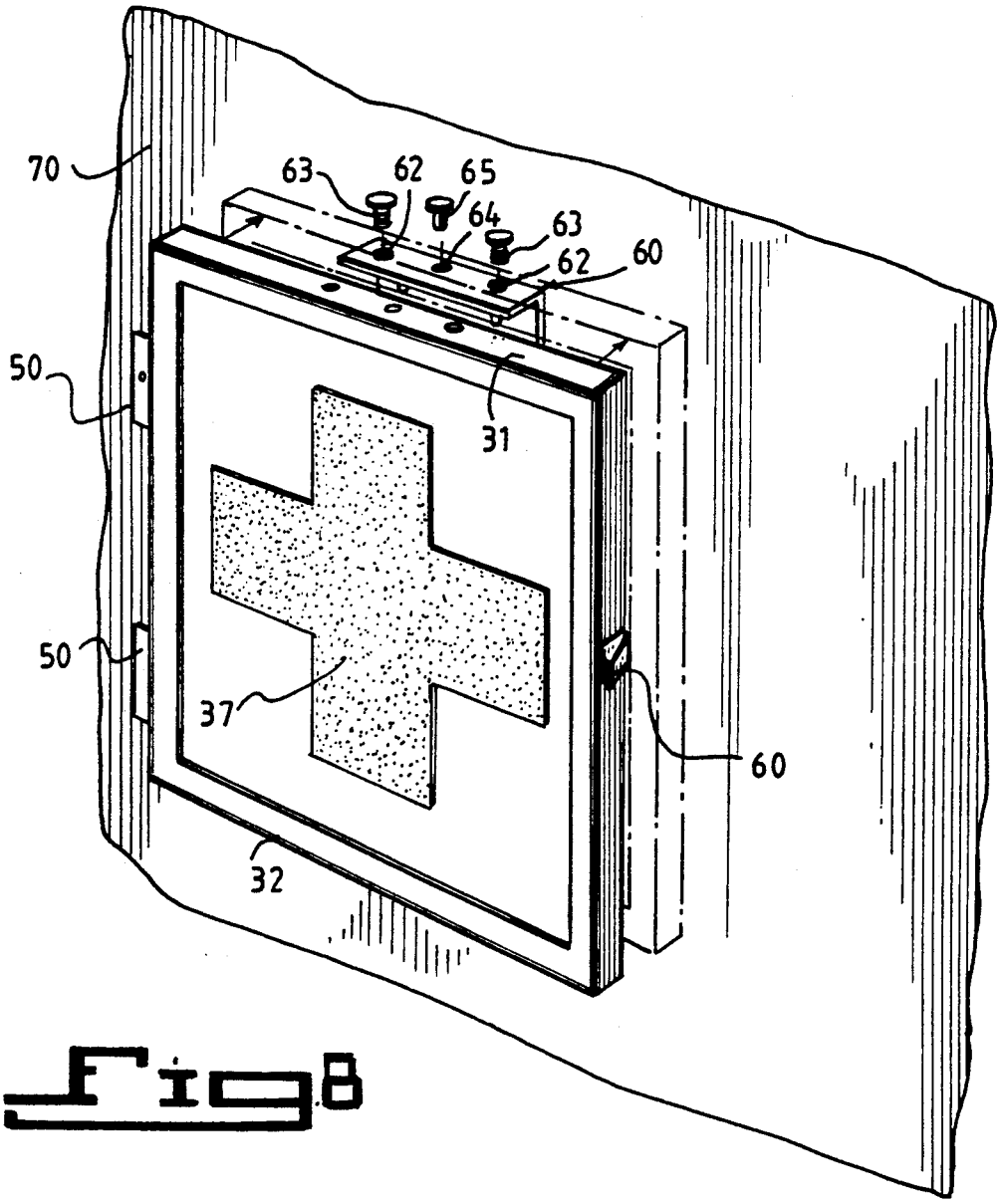
FIG. 8 is an exploded front elevational view of the picture frame being hung on the bracket of FIG. 7, showing its mounted position in phantom line.

As shown in FIGS. 7 and 8, an inverted, L-shaped wall support bracket or hinge, generally designated 60, may be used to hang frame 10. Hanger 60 has a horizontally-displayed, front leg 61 with two outer tapped holes 62, for receiving screws 63, and a counter-punched hole 64, for receiving a locating pin or rivet 65. Hanger 60 also has a vertically-displayed rear leg 66 having two spaced-apart punched, elongated slots 67 which serve to receive the screws 68 of conventional wall anchors. In mounting the frame 10, the hanger 60 would initially be secured to a wall 70 via slots 67, rear leg 66 and the wall anchors. Then the top frame section 31 of rear frame member 30 is positioned atop front leg 61, such that the three mounting holes 38 formed therein are aligned with holes 62, 63. Then the locating pin 65 is dropped through the center hole 63 to temporarily support the frame 10 on bracket 60 and aid in aligning the screw holes 62 with the outer holes 38 of frame section 31, so as to facilitate and permit more permanent securement via screws 63. of course, other types of mounting brackets and hangers common in the trade could be used in place of hanger 60.

The frame can be manufactured in numerous sizes. This allows all sorts of printed art items which have not been considered for conventional picture framing to be hung and displayed on the wall. As can be appreciated, many of these treasures which have been saved and, for the most part, hidden from view, relegated to boxes, closets, shelves and basement storage, can now be utilized for framing.

In particular, the display frame is specifically intended for collectors of comic books, magazines, e.g., *Life, TV Guide, The Saturday Evening Post,* with its Norman Rockwell covers, and numerous other publications; LP albums which are being phased out of the industry and are now collectibles, baseball and collector cards and numerous other items of printed nostalgia. It should also be appreciated that the back frame could possibly be appropriately adapted to contain other three-dimensional, collectible items, although in such case, the flat display board support 36 would have to be replaced with a shelve-like support. As can be appreciated, the frame allows the art work contained therein to be changed as often as desired, as opposed to current picture frames, wherein there is a sort of "permanency" once a picture has been framed and hung.

The present swing-open frame allows for easy insertion, removal or replacement of art work while the frame remains on the wall. In addition, the glass can be removed and replaced, the mat board can also be removed and replaced with different color mat boards and/or different size window openings, again, while the frame remains open and in secured fixed position on the wall.

Moreover, although it may take a couple of minutes, the entire single-channel front frame member can be removed from the backloader frame and replaced with another single-channel frame profile and/or color of which many are available at numerous frame shops. This can be achieved by a simple screwdriver. The entire frame invention can be removed from the wall to make this exchange and then rehung on the wall or the single-channel frame can be removed from the backloader frame by removing the hinge from the channel while the backloader remains on the wall.

Various modifications may be made to the present invention, as will be apparent to those skilled in the art. For example, although the frame sections are perfectly made from aluminum extrusion of a conventional single channel, metal frame, other materials, including wood or plastic, could, of course, be used. Furthermore, while the frame is preferably a side-loaded frame, the hinge could, e.g., be placed along the top frame section, if desired. In addition, the hinge could be spring-loaded so a to normally maintain the frame in the closed position. In this case, the latch could be omitted as the spring-loaded hinge would serve as a closure member. Such a latch-free embodiment would be acceptable for some applications such as photographs, thin multi-page printed items, and other simple graphic items or collectables. A thick magazine issue, such as Life Magazine, may not allow the hinge to press the front frame tight enough against the publication and therefore may not be desirable for that particular use.

If desired, the frame could be provided with a key lock (not shown) to prevent unauthorized opening. When locked, there is no immediate access to the art work displayed without a key. A valued art work such as a rare old comic book cannot be pilfered nor can unauthorized removal occur. Also, when locked, the frame, secured by screws to a steel wall hanger which in turn is secured to the wall by wall anchors and screws (into wallboard or plaster wall) or secured by deep screws into wood panel walls, is permanently fixed to the wall and therefore cannot be removed without destruction of the wall surface. As can be seen best in FIG. 8, the frame must be in the open position to allow for removal of screws by means of screwdriver from the frame and wall bracket.

Accordingly, while only one embodiment of the present invention has been shown and described, it is to be understood that many changes and modifications may be made thereunto without departing from the spirit and scope of the invention as disclosed herein.

What is claimed is:

1. A multi-purpose, front loading display frame, comprising:

a front frame member having a window section for viewing a display item disposed therebehind, said front frame member including a rectangular frame having top, bottom, and two side frame sections joined together to form a frame about an open area for display and a transparent window panel defining said window section mounted within said frame sections and occupying said open area so as to provide a front supporting and protective surface for a display item supported in said display frame, said front frame also having a recessed cavity;

a rear frame member, having a front surface for releasably supporting at least one interchangeable display item, which rear frame member is securable to a support, said rear frame member including a rectangular frame having top, bottom and two side frame sections jointed together to form a frame about an open area for display support and a display rear support for the display item mounted within said frame sections and occupying said display support open area so as to provide a rear support for the display item, wherein said rear support includes a rear panel which fits within said rear frame sections and has a flat surface for holding the display item against the window panel of said front frame member when said frame members abut one another in a closed position;

normally concealed hinge means for hingeably securing said front frame member to said rear frame member so as to allow for pivotable movement of said frame members between a closed position, in which said frame members are disposed closely adjacent to one another with said rear frame member received in said recessed cavity of said front frame member, so that a display item supported on said rear frame member is disposed behind said window section for viewing, and an open position, in which said frame members are pivoted apart from one another to permit removal and replacement of the display item, said hinge means being substantially concealed and hidden from view when said frame members are in said closed position; and normally concealed closure means mounted on at least one of said front and rear frame members for releasably maintaining said front and rear frame members in said closed position, said closure means being positioned so as to allow said front frame to swing outwardly via pivotable movement into said open position while said rear frame member is secured on a support, said closure means being substantially concealed and hidden from view when said frame members are in said closed position.

2. The display frame according to claim 1, wherein said front frame member additionally includes a rectangular mat board mounted in said frame member behind said window panel.

3. The display frame according to claim 1, wherein at least a portion of said flat surface of said rear panel is provided with adhesive means capable of temporarily adhering the display item to said rear panel.

4. The display frame according to claim 3, wherein said rear panel is compressible in said rear frame member so as to accommodate display items of different thickness.

5. The display frame according to claim 4, wherein said rear panel is spring loaded in said rear frame member.

6. The display frame according to claim 1, wherein said hinge means comprises a piano-type hinge.

7. The display frame according to claim 1, wherein said closure means comprises latch means.

8. The display frame according to claim 7, wherein said latch means comprises a frictionally releasable spring latch.

9. The display frame according to claim 1, additionally including hanger means for mounting said frame on a wall.

10. The display frame according to claim 9, wherein said hanger means includes an L-shaped bracket, one leg of which is securable to a wall and the other leg of which is securable to said rear frame member.

11. A multi-purpose, front loading display frame, comprising:

a front frame member having a window section for viewing a display item disposed therebehind, said front frame member including a rectangular frame having top, bottom, and two side frame sections joined together to form a frame about an open area for display and a transparent window panel defining said window section mounted within said frame sections and occupying said open area so as to provide a front supporting and protective surface for a display item supported in said display frame, said front frame also having a recessed cavity, said front frame member sections having a rear surface channel having a C-shaped cross-section;

a rear frame member, having a front surface for releasably supporting at least one interchangeable display item, which rear frame member is securable to a support, said rear frame member including a rectangular frame having top, bottom and two side frame sections joined together to form a frame about an open area for display support and a display rear support for the display item mounted within said frame sections and occupying said display support open area so as to provide a rear support for the display item, wherein said rear support includes a rear panel which fits within said rear frame sections and has a flat surface for holding the display item against the window panel of said front frame member when said frame members abut one another in a closed position;

hinge means for hingeably securing said front frame member to said rear frame member so as to allow for pivotable movement of said frame members between a closed position, in which said frame members are disposed closely adjacent to one another so that a display item supported on said rear frame member is disposed behind said window section for viewing, and an open position, in which said frame members are pivoted apart from one another to permit removal and replacement of the display item, said hinge means including a piano-type hinge having a front C-shaped leaf securably received in said rear surface channel of one of said front frame members; and closure means mounted on at least one of said front and rear frame members for releasably maintaining said front and rear frame members in said closed position, said closure means being positioned so as to allow said front frame to swing outwardly via pivotably movement into said open position while said rear frame member is secured on a support.

* * * * *